US008847760B1

(12) United States Patent
Watkins, Jr.

(10) Patent No.: US 8,847,760 B1
(45) Date of Patent: Sep. 30, 2014

(54) TAMPER-RESISTANT PURSE

(76) Inventor: George W. Watkins, Jr., Bedford, TX (US)

( * ) Notice: Subject to any disclaimer, the term of this patent is extended or adjusted under 35 U.S.C. 154(b) by 162 days.

(21) Appl. No.: 13/371,849

(22) Filed: Feb. 13, 2012

Related U.S. Application Data

(60) Provisional application No. 61/442,412, filed on Feb. 14, 2011.

(51) Int. Cl.

| | |
|---|---|
| ***G08B 13/14*** | (2006.01) |
| ***G08B 21/00*** | (2006.01) |
| ***F21V 33/00*** | (2006.01) |
| ***A45C 15/06*** | (2006.01) |

(52) U.S. Cl.
USPC ..... 340/568.7; 340/568.1; 340/665; 340/666; 340/686.1; 362/155; 362/156

(58) Field of Classification Search
USPC ..... 340/568.1, 568.7, 665–666, 686.1; 362/155–156
See application file for complete search history.

(56) References Cited

U.S. PATENT DOCUMENTS

| | | | | |
|---|---|---|---|---|
| 4,376,935 | A | 3/1983 | Castaldo | |
| 4,394,644 | A | 7/1983 | Di Leo et al. | |
| 5,027,105 | A | 6/1991 | Dailey et al. | |
| 5,126,719 | A | 6/1992 | DeSorbo | |
| 5,955,948 | A | 9/1999 | Howell | |
| 6,133,831 | A | 10/2000 | Kyles | |
| 7,758,118 | B1 * | 7/2010 | Good, Jr. | 297/217.4 |
| 7,961,914 | B1 * | 6/2011 | Smith | 382/115 |
| 2006/0250785 | A1 * | 11/2006 | Cugini et al. | 362/103 |
| 2009/0109029 | A1 * | 4/2009 | Shih | 340/568.7 |
| 2010/0053941 | A1 | 3/2010 | Ibison | |
| 2010/0279664 | A1 * | 11/2010 | Chalk | 455/414.1 |

* cited by examiner

*Primary Examiner* — Benjamin C Lee
*Assistant Examiner* — Adam Carlson
(74) *Attorney, Agent, or Firm* — Kenneth L Tolar

(57) ABSTRACT

A tamper-resistant purse includes a bag having a front surface, a rear surface, two opposing side edges, a lower surface and an open top in communication with an interior chamber. The open top is selectively enclosed with a foldable flap having a Hall-effect switch that changes states whenever the flap is opened. Extending from the bottom surface of the bag are a plurality of feet each having a pressure-sensitive switch therein. The pressure-sensitive switches and the Hall-effect switch are electrically connected to an alarm circuit including both audible and visual alarms. A strap is connected to a pair of detection switches that engage whenever a predetermined amount of force is applied to the strap. Accordingly, if the purse is moved, snatched or opened, the alarm is activated to alert those nearby of a potential theft.

12 Claims, 4 Drawing Sheets

TAMPER-RESISTANT PURSE

CROSS REFERENCE TO RELATED APPLICATIONS

This application is entitled to the benefit of provisional application No. 61/442,412 filed on Feb. 14, 2011.

BACKGROUND OF THE INVENTION

The present invention relates to a purse having an integral alarm that is activated whenever the purse is opened, moved or snatched.

DESCRIPTION OF THE PRIOR ART

Purse snatching is a common crime since purses are constantly exposed and typically contain valuables, such as cash and credit cards. Thieves can easily snatch the purse from a carrier's arm or shoulder and escape before being apprehended. Furthermore, a purse owner will often stow the purse beneath a table or chair, allowing someone to unknowingly remove the contents. Accordingly, there is currently a need for a purse that is resistant to theft or tampering.

A review of the prior art reveals a myriad of purse alarms that purportedly address the above-described problems. For example, U.S. Pat. No. 4,376,935 issued to Castaldo discloses a purse having an internal alarm that is activated when the purse is opened. In one embodiment, the purse is configured to resemble a dog having an activation switch positioned within one of the feet; the switch is formed of two contacts that are spring-biased in a spaced relationship such that lifting the bag causes the contacts to engage thereby activating the alarm.

U.S. Pat. No. 4,394,644 issued to Di Leo discloses a purse alarm having a switch received within a receptacle that is disarmed when a prong is inserted therein. The prong is tethered to a carrier's body such that the alarm is activated if the purse is snatched.

U.S. Pat. No. 5,027,105 issued to Dailey et al. discloses a briefcase having a motion sensor, such as an accelerometer, attached thereto for detecting unauthorized movement.

U.S. Pat. No. 5,126,719 issued to DeSorbo discloses a remotely-armed alarm for purses, briefcases and similar items.

U.S. Pat. No. 5,955,948 issued to Howell discloses a purse alarm that activates a remote alarm when the purse is opened.

U.S. published patent application no. 2010/0053941 filed on behalf of Ibison discloses a purse having internal lights for illuminating the interior whenever the purse is opened.

U.S. Pat. No. 6,133,831 issued to Kyles discloses a purse alarm that is activated by detachable straps if the purse is grabbed or snatched.

As indicated above, several purse alarms exist in the prior art. Most of the prior-art devices employ motion sensors, latch actuators or strap switches to activate an alarm if the purse is opened, moved or snatched. However, none of the prior art devices include a means for both audibly and visually alerting a user if the purse is either opened or moved. Therefore, the devices having strap switches are still susceptible to unauthorized entry while those having latch actuators do not prevent snatching or a surreptitious theft from a chair or beneath a table. Likewise, the purses containing motion sensors do not prevent unauthorized entry.

Furthermore, the prior-art alarm actuators have several disadvantages. For example, a purse having a latch switch can be stolen and later opened in a remote location where others are unlikely to hear the alarm. And, the latch switches still allow entry into the purse allowing the contents to be stolen if no one responds to the alarm. Likewise, a strap actuator can be bypassed by severing the strap while motion sensors only detect substantial movement. Additionally, even purse clasps that can be locked with a key are easily broken with conventional hand tools, allowing the contents to be easily stolen if the alarm is not heard or heeded. Finally, each of the prior-art devices is activated either locally or with a remote unit. However, remote units are easily lost or stolen which renders the alarm useless. Local arming mechanisms typically include a latch or magnets that keep an alarm circuit open when the purse is closed. Such mechanisms are susceptible to breaking, tampering and can be inconvenient and burdensome to manipulate.

The present invention provides a tamper-resistant purse that overcomes the above-described disadvantages associated with the prior art by providing an alarm that activates both audible and visual alarms if the purse is moved slightly, opened or snatched from a carrier's shoulder. Furthermore, the alarm circuit may be armed with a voice command in lieu of manipulating a remote unit. Finally, a latching mechanism with an associated fingerprint scanner prevents an unauthorized user from opening the purse irrespective of whether the alarm is activated or heeded.

SUMMARY OF THE INVENTION

The present invention relates to a tamper-resistant purse comprising a bag having a front surface, a rear surface, two opposing side edges, a lower surface and an open top in communication with an interior chamber. The open top is selectively enclosed with a foldable flap having a magnetic clasp on an inner surface that releasably seats within a mating receptacle on the front surface of the bag. The clasp and receptacle form a Hall-effect switch that changes states whenever the clasp is inserted or removed. Extending from the bottom surface of the bag are a plurality of feet, each having a pressure-sensitive switch therein that is wired in series with each of the other switches. A purse strap is connected to a pair of force-detecting switches positioned on the purse exterior. The pressure-sensitive switches, force detection switches and the Hall-effect switch are electrically connected to an alarm circuit, including both audible and visual alarms. Accordingly, if the bag is moved slightly, lifted by the strap, snatched or opened, the alarm is activated to alert those nearby of a potential theft.

It is therefore an object of the present invention to provide a tamper-resistant purse.

It is another object of the present invention to provide a tamper-resistant purse having an integral alarm that is activated whenever the purse is moved, opened or snatched.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
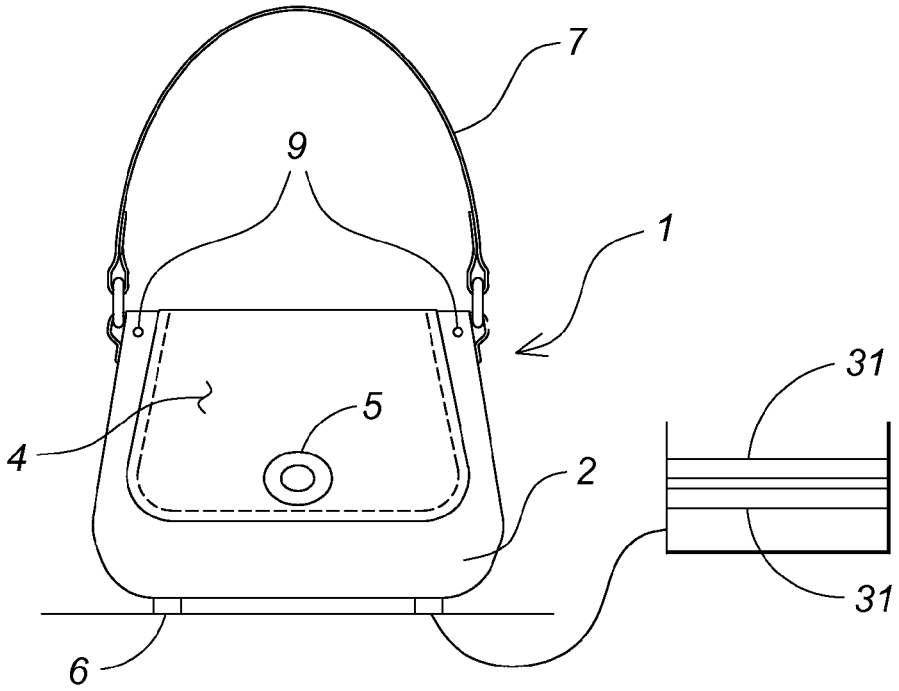
FIG. 1 is a front, plan view of the purse according to the present invention.
Figure 2:
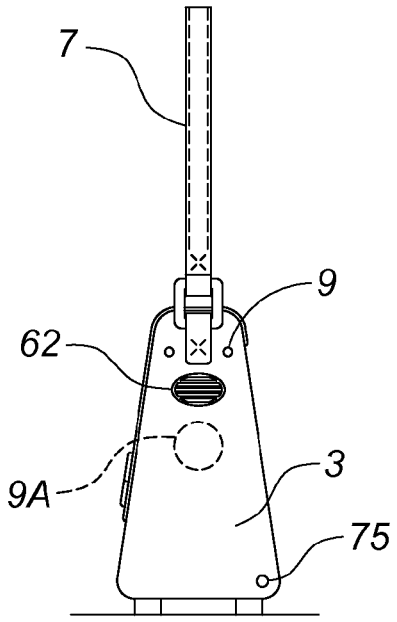
FIG. 2 is a side view of the purse.
Figure 3:
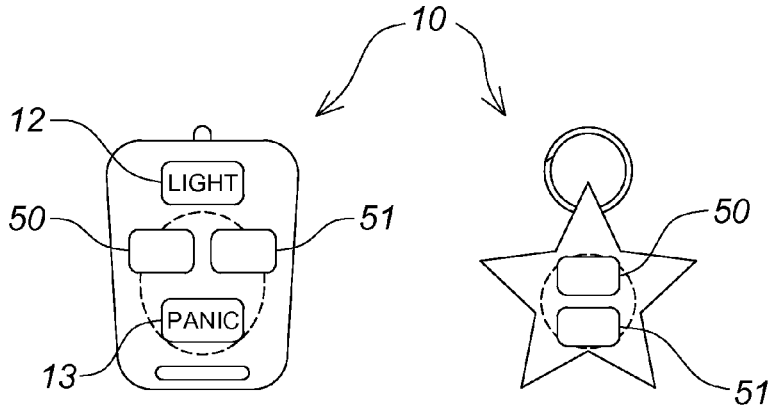
FIG. 3 is an isolated view of the remote unit.
Figure 4:
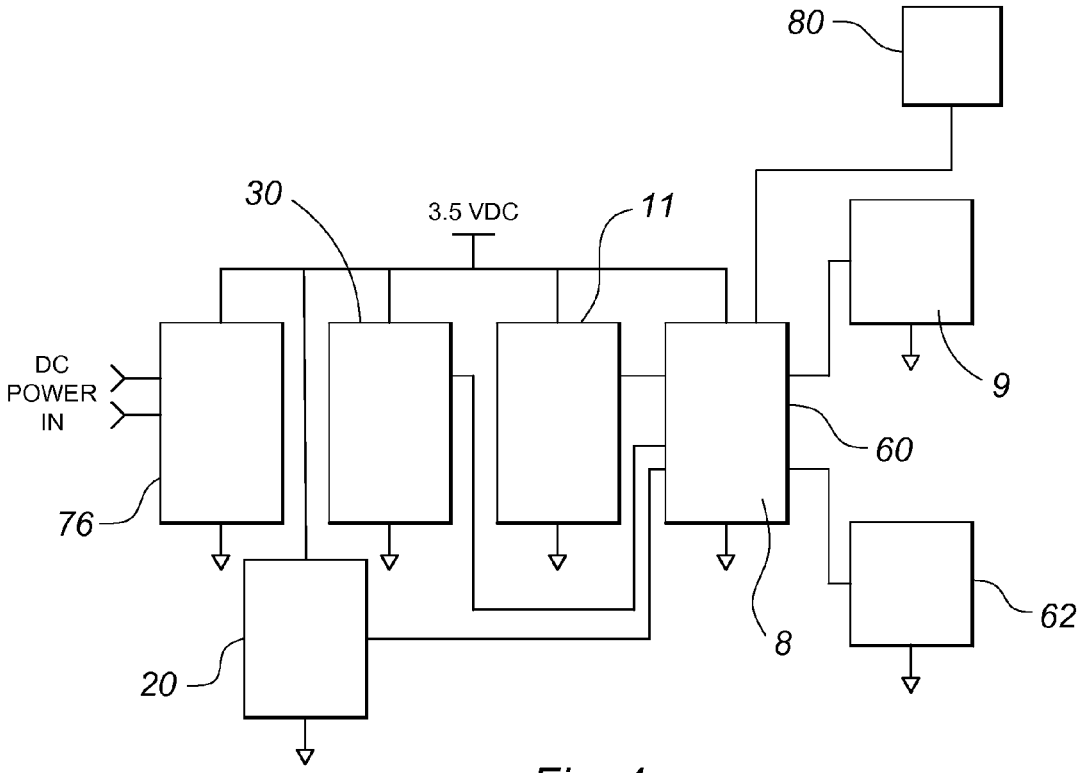
FIG. 4 is a schematic of the alarm circuit.
Figure 5:
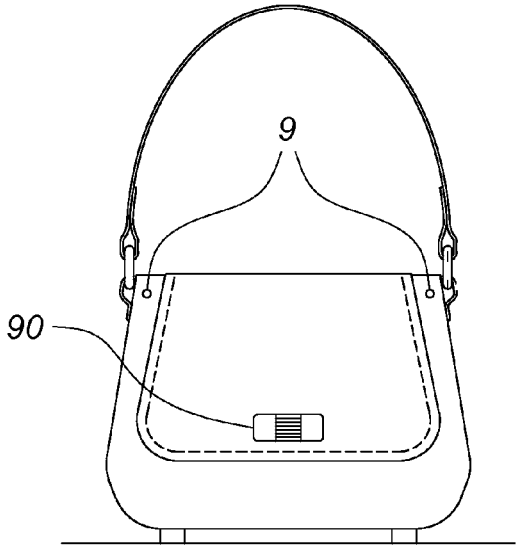
FIG. 5 is a front, plan view of a second embodiment of the present invention.
Figure 6:
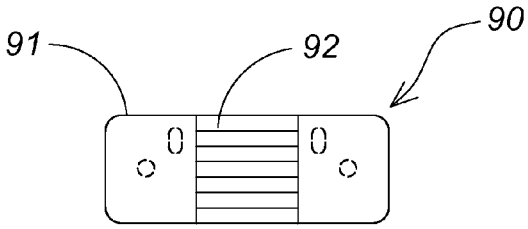
FIG. 6 is an isolated, front view of the fingerprint scanner.
Figure 7:
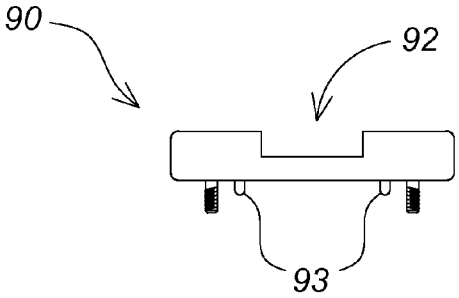
FIG. 7 is an isolated, side view of the fingerprint scanner.

The present invention relates to a tamper-resistant purse comprising a bag 1 having a front surface 2, a rear surface, two opposing side edges 3, a lower surface and an open top in communication with an interior chamber. The open top is selectively enclosed with a foldable flap 4 having a magnetic clasp 5 on an inner surface that releasably seats within a mating receptacle on the front surface of the bag. The clasp and receptacle form a Hall-effect switch 20 that changes states whenever the clasp is inserted or removed.

Extending from the bottom surface of the bag are a plurality of feet 6 constructed with carbon-impregnated, nitrile rubber. Embedded within each foot is a pressure-sensitive switch 30 formed of a pair of spaced contacts 31 that interrupt a low-resistance signal in the absence of a predetermined amount of pressure on the foot. The pressure-sensitive switches are wired in series so that pressure removal from any one of the feet alters the low-resistance signal, which notifies a monitoring microcontroller 60 that a state change has occurred and that an alarm, described, infra, should be activated.

Figure 8:
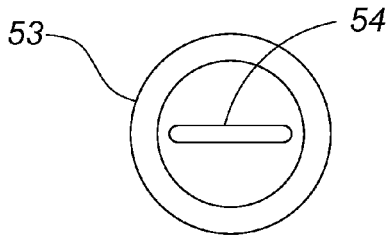
FIG. 8 is a top view of the strap switch.
Figure 9:
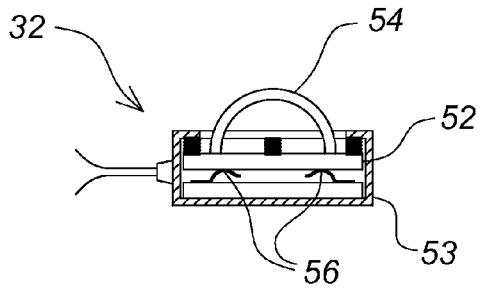
FIG. 9 is a side, sectional view of the strap switch.
Figure 10:
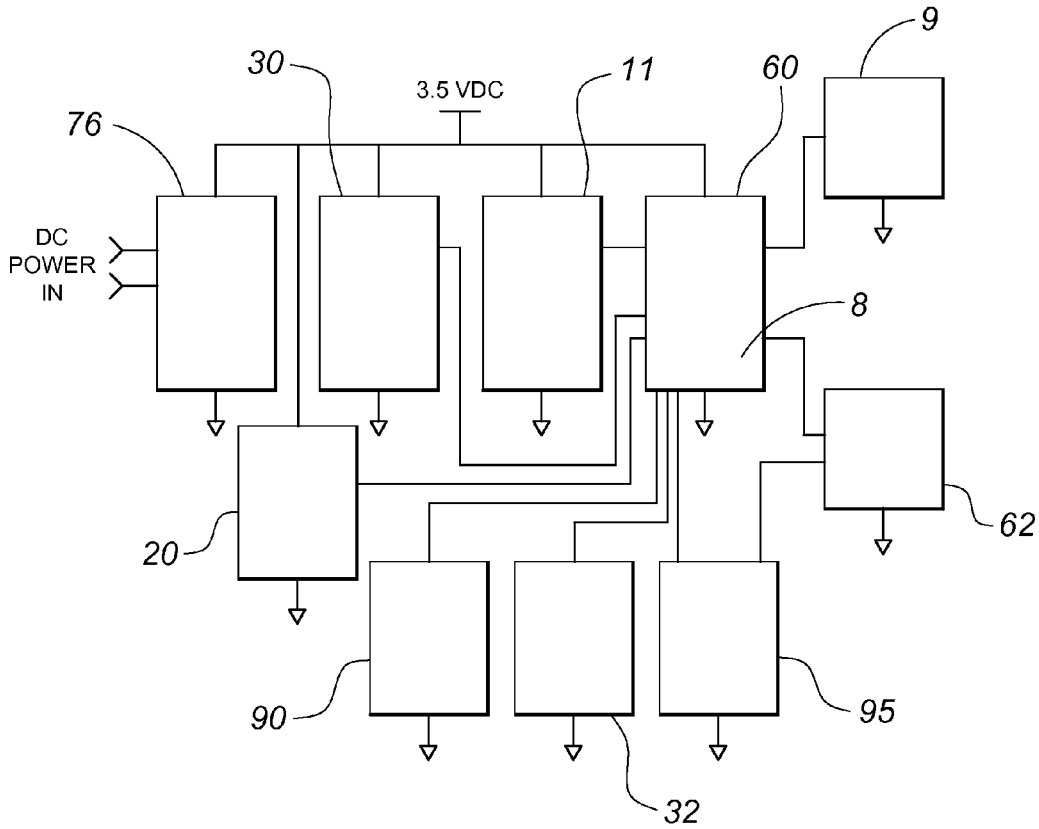
FIG. 10 is schematic of the alarm circuit according to the second embodiment.

Extending from one edge of the bag to the opposing edge is a shoulder strap 7; each end of the strap is fastened to a force-detection switch 32 for activating an alarm in response to a sudden movement of the type that usually accompanies a purse snatching. Referring specifically to FIGS. 8 and 9, each strap switch 32 includes a spring-biased plate 52 received within a casing 53. The plate includes a loop 54 at an upper end to which one end of each strap is removably secured. The plate is biased downwardly toward a lower contact that 56 is electrically connected to the alarm circuit described below. If an upward force applied to the strap is sufficient to offset the bias of the springs, the contact and plate separate thereby notifying a microcontroller 60 that a state change has occurred and that the alarm should be activated.

The pressure-sensitive switch within the feet, the strap switches and the Hall-effect switch are each electrically connected to an alarm circuit including the microcontroller 60 and an audible alarm 8, such as a voice chip or buzzer. The voice chip may be preprogrammed to include any number of verbal alert messages that notify those nearby that a theft is occurring. The audible alarm output is emitted through a speaker 62 mounted on each edge of the bag. The alarm circuit also includes a plurality of varying-colored LED's 9 that are pulsed in predetermined intervals or patterns so as to be immediately discernible to those nearby. Preferably, the LED's are dispersed about the entire bag exterior so that at least a portion are readily visible regardless of the purse's orientation or nearby obstructions. LED's 9A may also positioned within the bag interior for illuminating the contents when the purse is in use. A charging port 75 on an edge of the bag allows the alarm-circuit battery 76 to be conveniently recharged.

The alarm circuit is armed and disarmed with a remote unit 10 by depressing an arm 50 or a disarm 51 button that communicates with an integral wireless receiver 11. The remote unit also includes a button 12 for manually illuminating a select one or more of the LED's, such as the internal LED 9A to illuminate the bag interior, or a panic button 13 for manually activating the audible and visual alarms.

In lieu of a remote unit, the alarm circuit may be armed with a voice command using voice recognition software and a speech-to-data converter 95. Accordingly, a user can avoid the burdensome task of searching for a remote unit and manipulating a series of buttons in order to activate the alarm. Furthermore, the microcontroller may also include a 3-axis accelerometer 80 in order to determine if a sophisticated thief has severed the flap to bypass the Hall-effect switch while moving or tampering with the bag on a flat surface to prevent engagement of the feet switches.

Finally, the purse may include a user-recognition latch 90 in lieu of the magnetic clasp to further enhance the security of the purse's contents. The user-recognition switch includes a casing 91 mounted on the foldable flap having a capacitive fingerprint scanner 92 on the front surface thereof. The scanner is in communication with the microcomputer which determines whether a scanned fingerprint matches that belonging to an authorized user. On the rear surface of the casing are a plurality of retractable, spring-biased pins 93 that normally seat within mating receptacles formed on the purse. If an authorized user places a finger within the reader, the computer verifies the fingerprint and retracts the pins for a predetermined duration. After expiration of the predetermined duration, the microcomputer releases the pins, which are biased into their corresponding receptacles.

Accordingly, the alarm can be armed at various times according to the user's anticipated activities. For example, if a user plans to walk for a prolonged period of time, the purse strap can be placed about the shoulder and then the alarm can be armed with the remote unit or voice command. Therefore, any pulling on the strap or opening the bag triggers an alarm. Or, the bag could be placed onto a horizontal surface and armed. Any lifting of the strap, or slight movement or opening of the bag the bag would trigger the alarm.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A tamper-resistant purse comprising:

a bag having a front surface, a rear surface, two opposing side edges, a lower surface and an open top in communication with an interior chamber, said open top selectively enclosed with a flap having a closure thereon;

an alarm means for emitting a warning signal upon either of said closure being released by an unauthorized user and said bag being moved by an unauthorized user, wherein said alarm means comprises a first switch integral with said closure, a plurality of lights in communication with said first switch, said lights disposed on the front surface, the rear surface and the opposing side edges of said bag, said lights illuminated when said closure is released, an audible alarm in communication with said first switch, a plurality of feet extending from the bottom surface of said bag, and a pressure-sensitive switch embedded within each of said feet and connected to said lights and said audible alarm, the pressure-sensitive switch within each of said feet connected in series to the pressure sensitive switch within every other of said feet whereby slight movement of any one of said feet will activate said audible alarm and said visual alarm.

2. The purse according to claim 1 wherein said closure comprises a magnetic clasp on an inner surface of said flap that releasably seats within a mating receptacle on the front surface of the bag, said clasp and said receptacle forming a Hall-effect switch that changes states whenever the clasp is inserted and removed.

3. The purse according to claim 1 wherein said alarm means further comprises:

a pair of force-detection switches mounted on said bag and connected to said lights and said audible alarm;

a shoulder strap having two opposing ends, each of said ends attached to one of said force-detection switches whereby applying a predetermined amount of lifting force to said trap illuminates said lights and activates said audible alarm.

4. The purse according to claim 3 wherein said force detection switches each include a spring-biased plate received within a casing, said plate having a loop at an upper end to which one end of said strap is secured, said plate biased downwardly toward a lower contact that is electrically connected to said lights and said audible alarm whereby when a predetermined amount of upward force is applied to the strap, said contact and said plate separate.

5. The purse according to claim 1 further comprising a means for arming said alarm means.

6. The purse according to claim 5 wherein said means for arming said alarm means is a remote unit.

7. The purse according to claim 5 wherein said means for arming said alarm means is a voice recognition circuit that transmits an authorization signal upon entry of a predetermined spoken command.

8. The purse according to claim 1 further comprising a means for manually illuminating at least one of said lights.

9. The purse according to claim 1 wherein at least one of said lights is disposed within the interior chamber of said bag.

10. The purse according to claim 1 further comprising means for manually activating said lights and said audible alarm.

11. The purse according to claim 1 wherein said alarm means further comprises a 3-axis accelerometer in communication with said lights and said audible alarm to generate an audible and visual alert if a thief severs said flap to bypass said Hall-effect switch while moving said bag on a flat surface to prevent engagement of said pressure-sensitive switch.

12. The purse according to claim 1 wherein said closure comprises a user-recognition latch comprising:

a casing mounted on said flap having a fingerprint scanner on a front surface thereof;

a plurality of retractable, spring-biased pins on a rear surface of the casing that retractably seat within receptacles formed on said bag whereby an authorized user places a finger within the reader to retract the pins for a predetermined duration.

* * * * *